US009126213B2

(12) United States Patent
Haruch

(10) Patent No.: US 9,126,213 B2
(45) Date of Patent: Sep. 8, 2015

(54) MULTIPLE DISCHARGE PRESSURIZED AIR ATOMIZATION SPRAYING SYSTEM

(75) Inventor: James Haruch, Naperville, IL (US)

(73) Assignee: Spraying Systems Co., Wheaton, IL (US)

( * ) Notice: Subject to any disclaimer, the term of this patent is extended or adjusted under 35 U.S.C. 154(b) by 823 days.

(21) Appl. No.: 13/357,881

(22) Filed: Jan. 25, 2012

(65) Prior Publication Data

US 2013/0186984 A1 Jul. 25, 2013

(51) Int. Cl.

| | |
|---|---|
| ***B05B 1/14*** | (2006.01) |
| ***B05B 7/04*** | (2006.01) |
| *B05B 7/12* | (2006.01) |

(52) U.S. Cl.

CPC ..... *B05B 1/14* (2013.01); *B05B 7/0466* (2013.01); *B05B 7/0491* (2013.01); *B05B 7/1263* (2013.01)

(58) Field of Classification Search

CPC ..... B05B 1/14; B05B 7/0466; B05B 7/1263; B05B 7/0491

USPC ..... 239/399, 427, 432, 433, 499, 548, 543

See application file for complete search history.

(56) References Cited

U.S. PATENT DOCUMENTS

| | | | | |
|---|---|---|---|---|
| 4,154,304 | A * | 5/1979 | Steibing et al. | 169/74 |
| 4,591,099 | A * | 5/1986 | Emory et al. | 239/419 |
| 4,645,129 | A * | 2/1987 | Terrade et al. | 239/427 |
| 5,603,453 | A * | 2/1997 | Weaver et al. | 239/8 |
| 5,732,885 | A | 3/1998 | Huffman | |
| 5,899,387 | A | 5/1999 | Haruch | |
| 6,322,003 | B1 | 11/2001 | Haruch | |
| 6,726,127 | B2 | 4/2004 | Hofherr et al. | |
| 7,588,199 | B2 * | 9/2009 | Huffman | 239/416.5 |
| 7,717,059 | B2 | 5/2010 | Wanthal et al. | |
| 2004/0222317 | A1 * | 11/2004 | Huffman | 239/398 |
| 2006/0038041 | A1 | 2/2006 | Huffman et al. | |
| 2006/0097070 | A1 | 5/2006 | Huffman | |

OTHER PUBLICATIONS

United States Patent and Trademark Office, International Search Report in the International Patent Application No. PCT/US13/22867 (Apr. 9, 2013).

United States Patent and Trademark Office, Written Opinion of the International Searching Authority in the International Patent Application No. PCT/US13/22867 (Apr. 9, 2013).

* cited by examiner

*Primary Examiner* — Jason Boeckmann

(74) *Attorney, Agent, or Firm* — Leydig, Voit & Mayer, Ltd.

(57) ABSTRACT

A liquid spray device having an atomizing unit for pressurized air atomization of a liquid flow stream, a plurality of atomized liquid direction passages disposed in eccentric relation to a central liquid flow passage of the atomizing unit, a plurality of flexible tubes each communicating with a respective one of the eccentric passages, and a spray nozzle coupled to a downstream end of each tube for discharging atomizing liquid at the selected location of the spray nozzle. The illustrated atomizing unit is a multi-component assembly that includes an air and liquid supply body, an air guide for directing atomizing air, an impact adaptor defining a liquid impingement surface, and a atomized director fitting defining the plurality of eccentric atomized liquid passages. The atomizing unit may be in a form of a spray gun designed for flushing atomized liquid from the elongated flexible tubes or instantaneously shutoff.

13 Claims, 8 Drawing Sheets

MULTIPLE DISCHARGE PRESSURIZED AIR ATOMIZATION SPRAYING SYSTEM

FIELD OF THE INVENTION

The present invention relates generally to spray nozzle assemblies, and more particularly, to air atomizing liquid spray nozzle assemblies in which pressurized liquid and air flow streams are intermixed to atomize the liquid into fine liquid particles prior to and/or during discharge from the spray nozzle.

BACKGROUND OF THE INVENTION

Air atomizing spray nozzles are well known for generating fine particle liquid spray distributions for many industrial and agricultural uses. Such spray nozzle assemblies typically comprise a spray gun or head into which pressurized liquid and air streams are directed and upon which is mounted on and air cap and spray nozzle assembly. The liquid typically passes centrally through the spray gun or head and spray nozzle assembly with pressurized air streams being directed circumferentially about the central liquid flow stream for intermixing and atomizing the liquid prior to and/or during discharge from the spray nozzle assembly. Such spray nozzle assemblies, and particularly spray guns which include a cyclically operated control valve needle and actuating mechanism, can be bulky and do not lend themselves to manual handling or easy mounting in confined spaces. Moreover, when it is necessary to direct such atomized spray to a plurality of different locations or directions, a plurality of such spray guns are required, which is costly.

OBJECTS AND SUMMARY OF THE INVENTION

It is an object of the present invention to provide a pressurized air atomizing liquid spray nozzle assembly adapted for more versatile usage.

Another object is to provide a pressurized air atomizing spray nozzle assembly as characterized above from which the finely atomized liquid can be selectively directed to a plurality of different target areas or discharge locations.

A further object is to provide a pressurized air atomizing spray nozzle assembly of the foregoing type in which atomized liquid can be directed to a plurality of locations remote from a liquid controlling spray gun or mixing head.

Still another object is to provide a pressurized air atomizing spray nozzle assembly of the above kind that is relatively simple in construction and lends itself to economical manufacture and use.

Other objects and advantages of the invention will become apparent upon reading the following detailed description and upon reference to the drawings, in which:

Figure 1A:
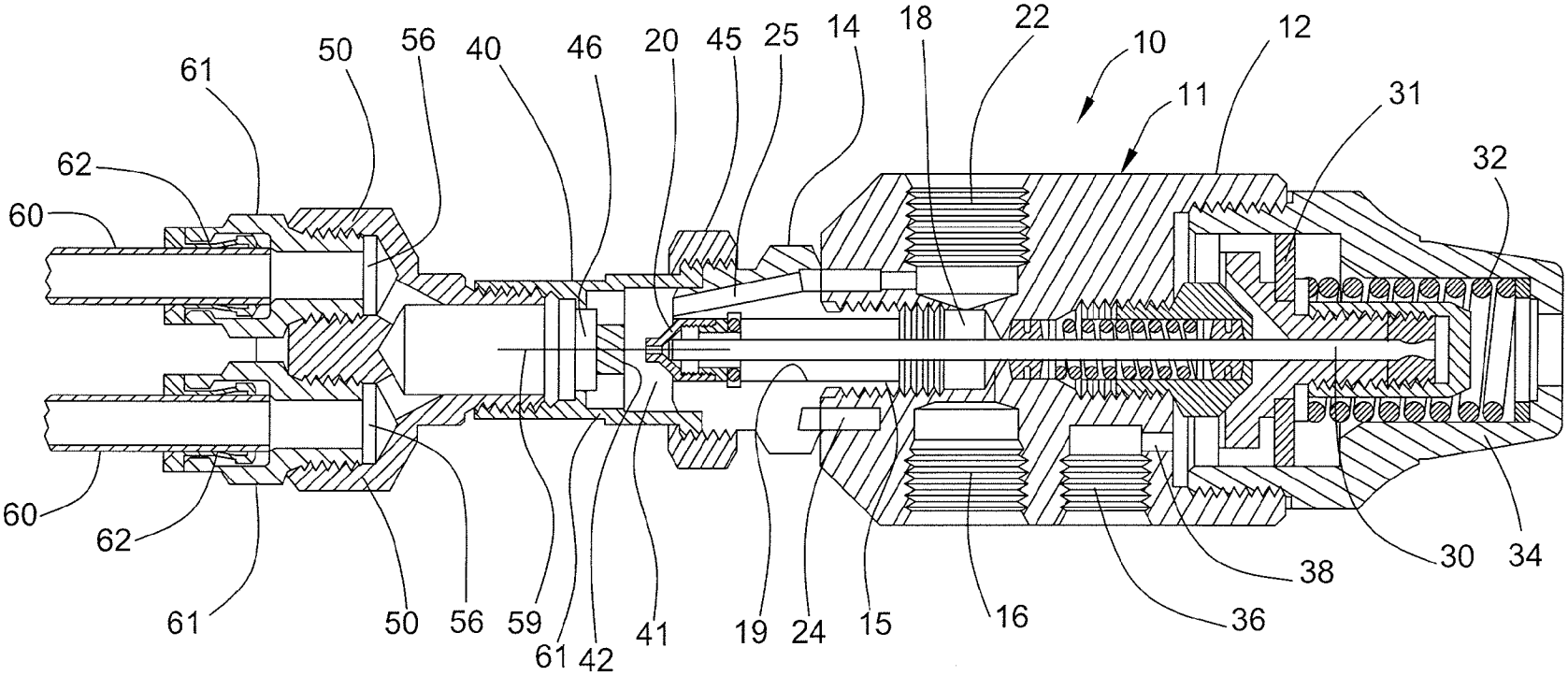
FIGS. 1A and 1B are broken views of an illustrated spray device in accordance with the present invention.

While the invention is susceptible of various modifications and alternative constructions, certain illustrative embodiments thereof have been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DESCRIPTION OF THE PREFERRED EMBODIMENTS

Figure 1B:
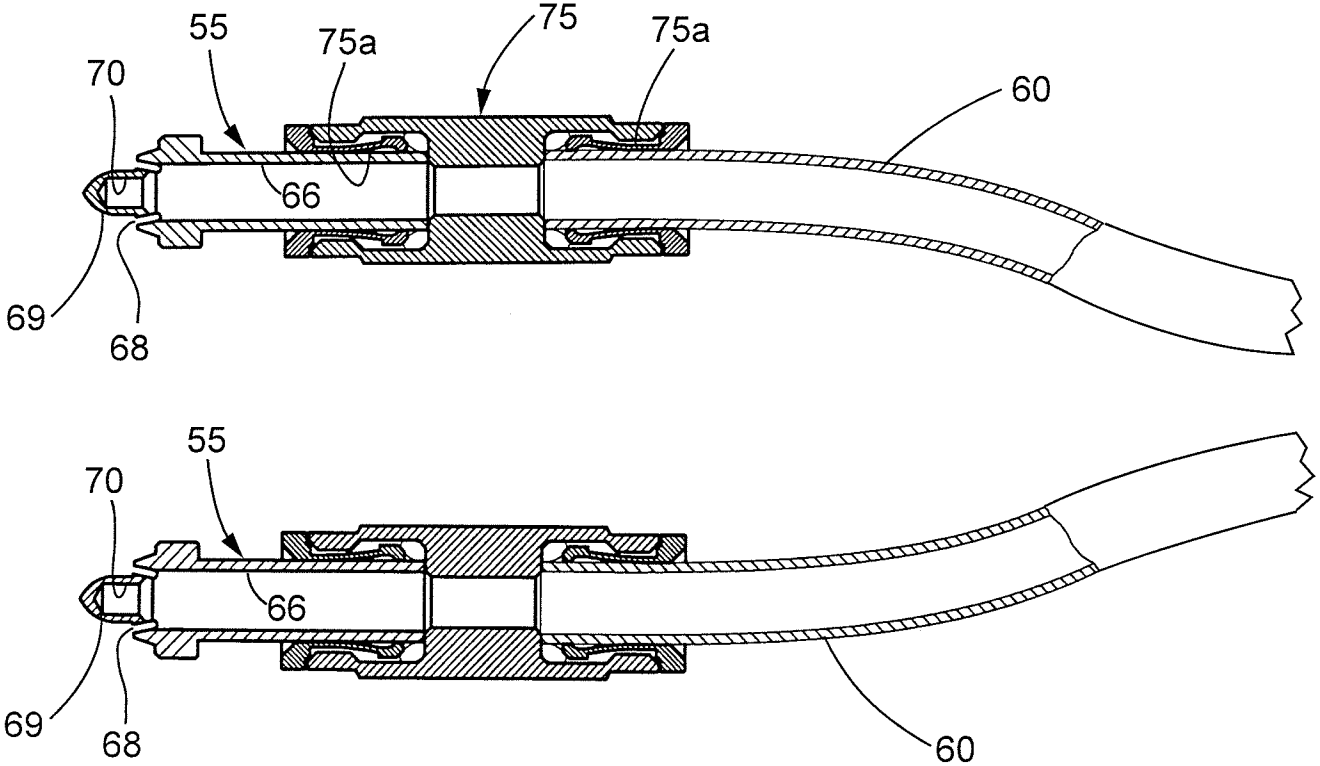

Referring now more particularly to FIGS. 1A and 1B of the drawings, there is shown an illustrative spray device 10 in accordance with the invention which includes a pressurized liquid and air atomizing head, in this case in the form of a spray gun 11, which includes an elongated body 12 and an air guide 14 mounted on a downstream end of the body 12. The air guide 14 in this case is secured to the elongated body 12 by an externally threaded upstream stem 15 that is engageable within a central thread bore of the elongated body 12. The elongated body 12 has a liquid inlet 16 that communicates with a central liquid passages 18,19 through the body 12 and air guide 14. The air guide 14 has a spray tip 20, which may be integral with the air guide 14 or a separate tip fixedly mounted in the air guide as shown, having an inwardly converging liquid passage section for accelerating a liquid flow stream discharging from a discharge orifice of the spray tip 20.

The elongated body 12 further has an atomizing air inlet 22 that communicates with an annular air manifold chamber 24 defined between the body 12 and the air guide 14, which in turn communicates pressurized atomizing air from a pressurized air supply through a plurality of air passages 25 that taper inwardly in a downstream direction for discharging atomizing air in inwardly converging relation about a liquid flow stream discharging from the spray tip 20.

For controlling the discharge of liquid from the spray gun 11, a valve needle 30 is disposed centrally within the liquid passages 18,19 for slidable reciprocable movement. The basic mode of operation of the spray gun 11 is known in the art, for example, as shown in U.S. Pat. No. 5,707,010, the disclosure of which is incorporated herein by reference. The valve needle 30 has an upstream piston assembly 31 biased in a downstream spray tip closing direction by a coil spring 32 interposed between the piston assembly 31 and an annular retaining cap 34 fixed in threaded engagement with an upstream end of the body 12. For selectively moving the valve piston assembly 31 and needle 30 to a spray tip opening position for permitting the passage of liquid through the spray tip 20, the body 12 has a control air inlet 36 and passageway 38 communicating with a downstream side of the piston assembly 31 for forcing the piston assembly 31 and valve needle 30 to an open position against the force of the biasing spring 32 upon a controlled direction of pressurized air through the control air inlet 36. The supply of pressurized air may be controlled externally, such as by a solenoid actuated valve, for controlled opening of the valve needle 30. It will be appreciated that the valve needle 30 may be selectively operated between on and off positions, including operation in high speed cyclic on-off modes.

Figure 3:
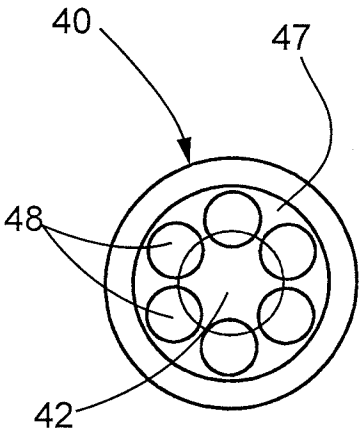
FIGS. 3 and 4 are upstream and downstream end views, respectively, of the impact adaptor shown in FIG. 2.
Figure 2:
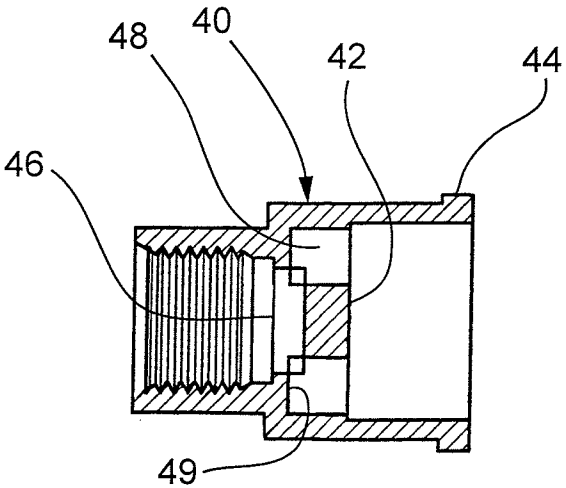
FIG. 2 is a longitudinal section of an impact adaptor component of the illustrated spray device.
Figure 4:
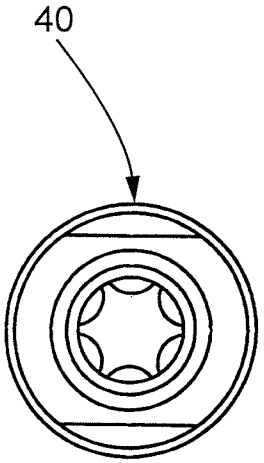

In accordance with the invention, a plurality of spray nozzles are provided which communicate in eccentric relation with the spray gun central liquid passage for the individual discharge of atomized liquid at locations remote from each other. To this end, in the illustrated embodiment, the spraying device 10 includes an impact adaptor 40 fixed in downstream relation to the air guide 14 for defining an annular expansion chamber 41 about a protruding discharge end of the spray tip 30 and a central impingement surface 42 in axial alignment with discharge from the spray tip 20. The impact adaptor 40, as best depicted in FIGS. 2-4, in this case has an annular construction with an outwardly extending radial retaining flange 44 at an upstream end that can be fixed to the air guide 14 by a retaining ring 45 threadably engageable about a downstream end of the air guide 14. The impact adaptor 40 has a transverse wall 47 intermediate its ends which defines the impingement surface 42 and an expansion chamber 46 downstream of the transverse wall 47. The impingement surface 42, being located in perpendicular close proximity to the discharge end of the spray tip 20, will cause the discharging liquid flow stream from the spray tip 20 to shatter into fine particles that are dispersed radially outwardly of the impingement surface 42 and sheared with high velocity air streams discharging from the multiplicity of air discharge passages 25 in the air guide 14 causing intimate interaction and liquid breakdown into finely atomized liquid particles that are thereupon directed through a plurality of circumferentially spaced flow passages 48 about the impingement surface 42 that extend through the transverse wall 47. The passages 48 in this instance have partial end walls 49 at downstream ends that each define a flat deflector surface for channeling the preatomized liquid in a downstream direction while further enhancing the liquid particle breakdown.

Figure 6:
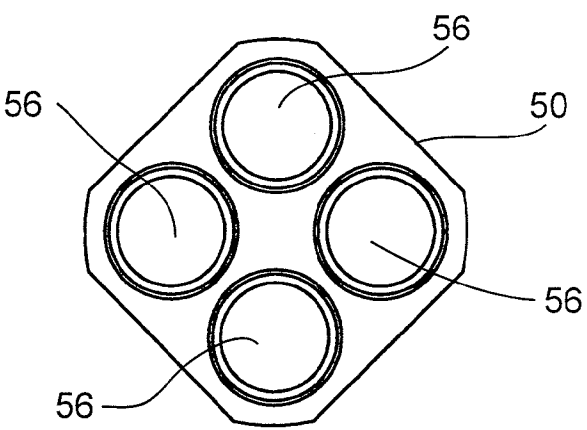
FIG. 6 is a downstream end view of the director fitting shown in FIG. 5.
Figure 8:
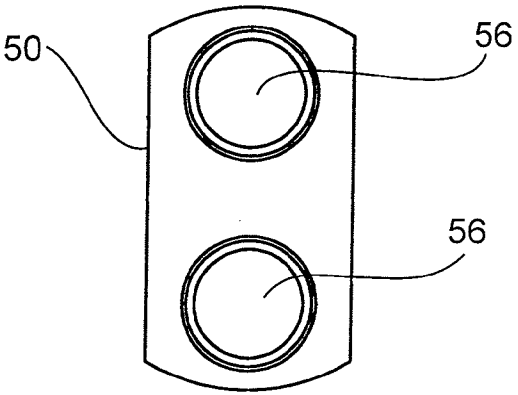
FIGS. 7 and 8 are alternative embodiments of director fittings with different arrangements of eccentric outlet passages.
Figure 5:
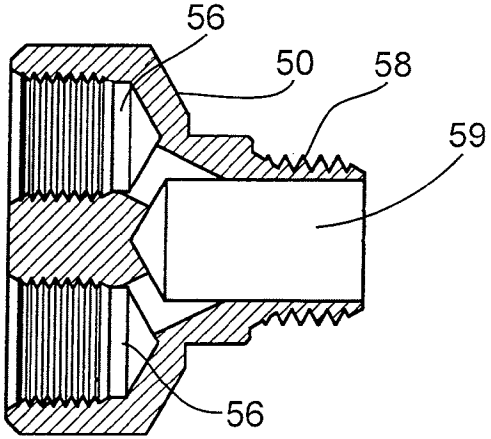
FIG. 5 is a longitudinal section of an atomized liquid director fitting of the illustrated spray device.
Figure 7:
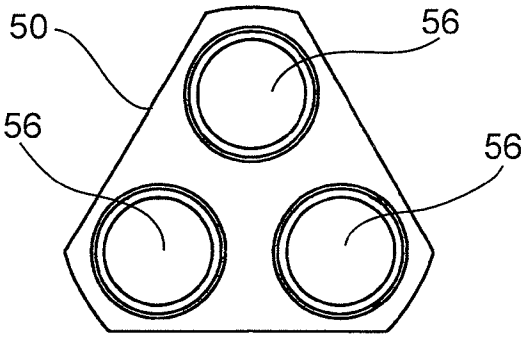

In further carrying out the illustrated embodiment, the spray device 10 includes an atomized liquid director fitting 50 fixedly secured to a downstream end of the impact adaptor 40 for communicating preatomized liquid to a plurality of spray nozzles 55 communicating with the director fitting 50 by respective passages 56 eccentric to a central inlet passage 59. The director fitting 50, as depicted in FIGS. 5 and 6, comprises a threaded stem 58 which engages an internally threaded downstream end of the impact adaptor 40 and defines the central passage 59. The central passage 59 in turn communicates with the plurality of atomized liquid passages 56 disposed in eccentric relation to the central passage 59. In the illustrated embodiment, the central passage 59 communicates with four eccentric passages 56 disposed in 90° circumferentially spaced relation about the central passage 59. Alternatively, as depicted in FIGS. 7 and 8, the outer passage 59 may communicate with lesser or greater numbers of circumferentially offset passages 56 for the particular spray application.

In keeping with the illustrated embodiment, each eccentric passage 56 of the director fitting 50 communicates with a respective elongated flexible tubing or hose 60 for directing atomized liquid to a respective discharge spray nozzle 55 that is selectively located or positionable remote from the spray gun 11. For this purpose, in the illustrated embodiment, each eccentric passage 56 threadedly receives a respective hose fitting 61, which in the illustrated embodiment is a conventional push type hose fitting. The downstream end of each hose fitting 61 comprises a plurality of inwardly biased circumferentially spaced fingers 62 which are urged radially outwardly upon insertion of an end of the hose 60 into the fitting 61 for positively engaging and retaining the end of the hose 60. In many applications, the hoses 60 may be flexible plastic tubings up to 20 feet and more in length, while in other more permanent or harsh applications, metal hose or tubing may be utilized with screw-in unions for coupling with the director fitting 50. In either case, preatomized liquid flow streams from the eccentric passages 56 of the director fitting 50 will be directed along the length of the hose 60 in a turbulent and pressurized manner.

Figure 9:
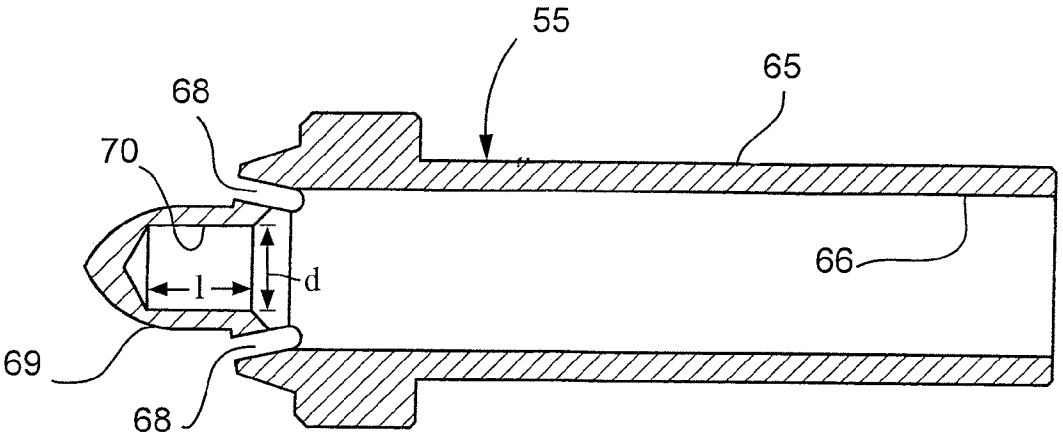
FIG. 9 is a longitudinal section of one of the discharge spray nozzles of the illustrated spray device.

In further keeping with this embodiment, each hose 60 carries a respective of the spray nozzle 55 at a terminal end thereof, which is adapted for enhancing liquid atomization prior to discharge from the spray nozzle 55. In the illustrated embodiment, as depicted in FIG. 9, each spray nozzle 55 includes an elongated body portion 65 having a central liquid passage 66, a plurality of discharge orifices 68 adjacent a downstream end communicating with the central passage 66, and a closed central nose portion 69 extending downstream of the discharge orifices 68 formed with a smaller diameter resonant mixing cavity 70. The mixing cavity 70 in this case has a diameter d about one half the diameter of the central spray nozzle passage 66 and extends a length l at least greater than the diameter of the central nozzle passage 66 in closed fashion downstream of the discharge orifices 68. The discharges orifices 68, as depicted in FIG. 9, comprise a pair of opposed cross slots extending in outwardly flared relation to each other at an angle to the longitudinal axis of the nozzle 55.

Figure 10:
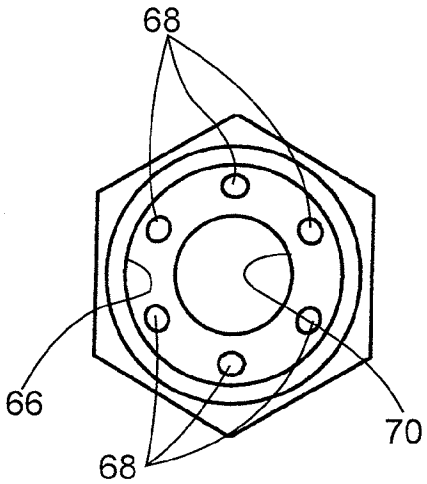
FIG. 10 is a downstream end view of the spray nozzle shown in FIG. 9.

The forwardly extending mixing cavity 70 unexpectedly has been found to enhance atomization of the preatomized liquid particles by creating a turbulent condition of the preatomized liquid adjacent the discharge orifices 68 that further enhances fine particle breakdown of the liquid as an incident to discharge from the spray nozzle 55 into the relatively lower pressure of the atmosphere. It will be understood that the spray nozzles 55 may have other forms of discharge orifices 68, such as a plurality of circumferentially spaced orifices 68, as depicted in FIG. 10, for producing a wide angle round spray pattern, as well as discharge orifice configurations for producing flat or other forms of round spray patterns. Each spray nozzle 55 in this case each is secured to the end of a respective hose or tube 60 by a fitting 75 having a push pull receptacle **75*a* similar to that of the fittings 61 of the director fitting 50. The downstream end of each hose 60 in this case is pushed into a similar receptacle fitting 75*a*** for secure retention.

It will be appreciated by one skilled in the art that the spray device 10 of the present invention has considerable utility over conventional spray guns or the like in which an air cap and liquid discharge spray tip are mounted directly on the end of the spray gun or head. While the illustrated spray gun 11 may be mounted at a fixed location, it can been seen that the spray nozzles 55 may be selectively located at various spray locations remote from the spray gun 11. It will be understood that this can be particularly desirable in coating applications in which it is necessary to spray objects from a multiplicity of directions for complete coverage, in humidification systems where it is desirable to direct moisture into the air at a plurality of locations, and in spraying systems in which spray nozzles are permanently mounted and are periodically used, such as in pesticide applications. In the latter case, mounting the spray nozzles 55 in the wall or other access areas enables the hoses 60 to be simply pushed into the spray nozzle fittings for a particular application, enabling the spray gun 11 to be easily carried to different job locations.

Figure 11:
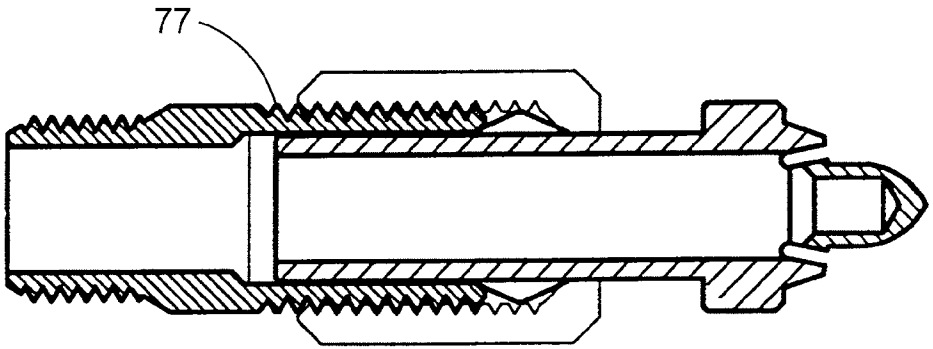
FIG. 11 is a longitudinal section of an alternative embodiment in which the spray nozzles are coupled to the flexible hose by a threaded fitting.
Figure 12:
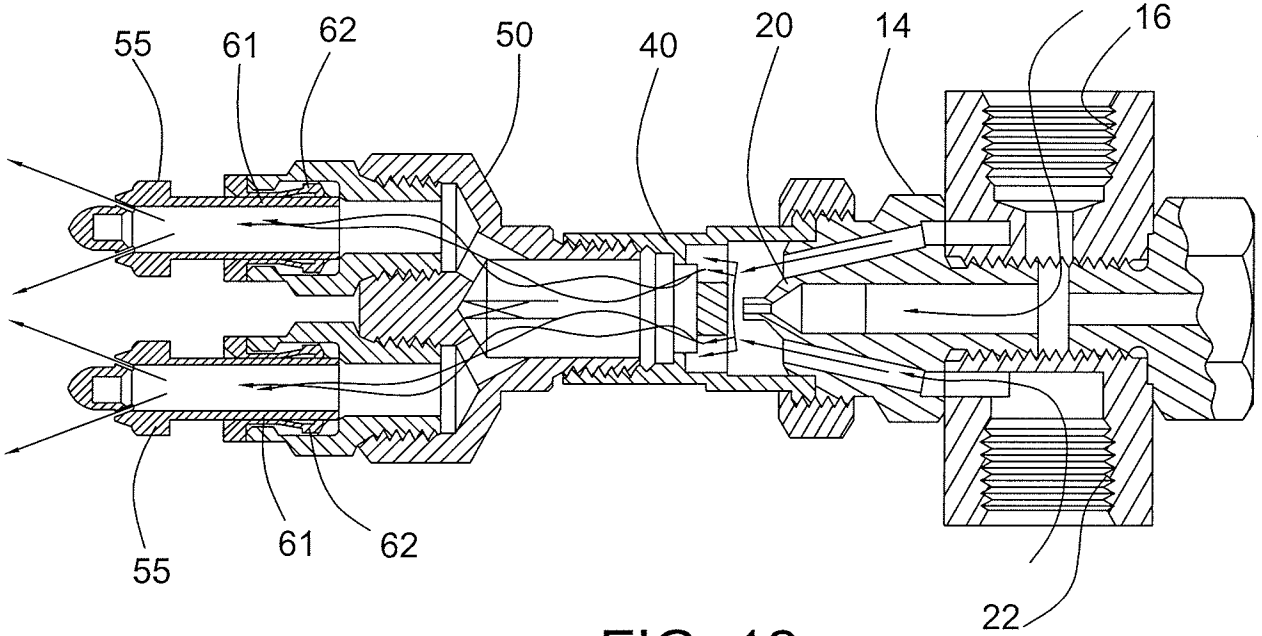
FIG. 12 is a longitudinal section of an alternative embodiment of the spray device in accordance with the invention.
Figure 13:
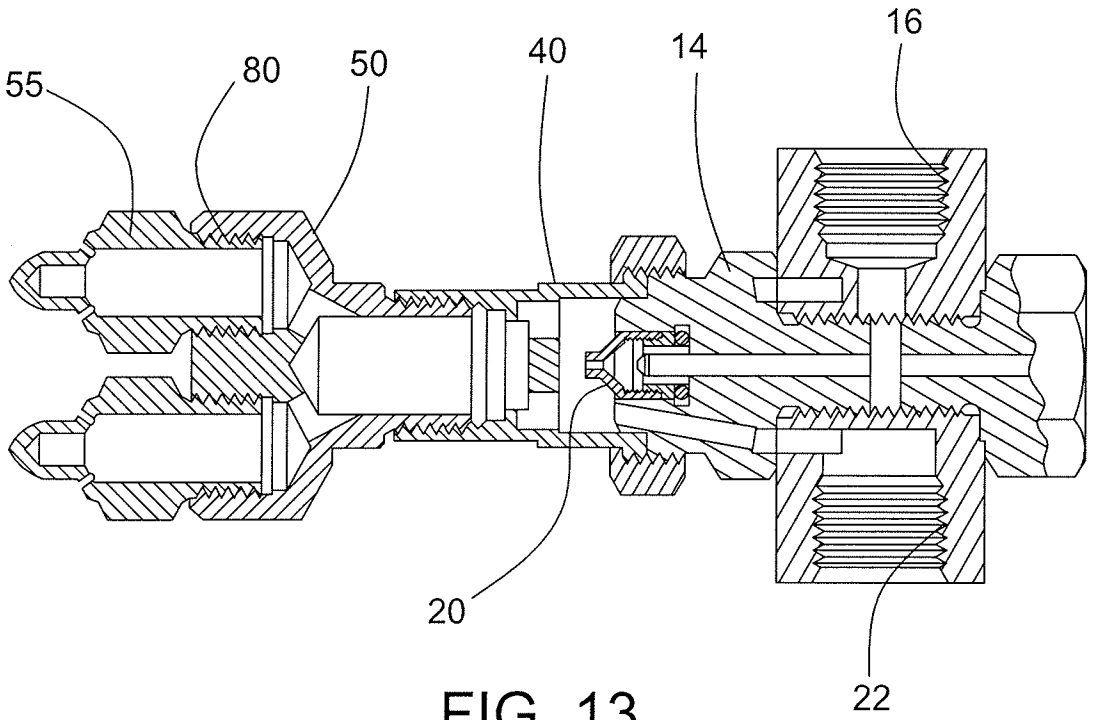
FIG. 13 is a longitudinal section of still another alternative embodiment of the spray device in accordance with the invention.

While in the illustrated embodiment the spray gun 11 comprises a plurality of inter-connected components, namely the elongated body 12, the liquid and air guide 14, the impact adaptor 40, and the liquid director fitting 60 which together form a liquid atomizing unit, alternatively, the components may be integrally connected, or fewer or greater number of component parts may be utilized. While the illustrated embodiment has been shown in connection with a cyclically operated spray gun 11, it further will be understood that the invention can be easily used with non-cyclic preatomizing spray heads. It will further be understood, as indicated previously, that while the multiplicity of spray nozzles 55 may be connected to the atomized liquid director fitting 50 by plastic tubing 6, in more severe or demanding environments, flexible copper tubing or the like may be utilized. In those environments, it also may be desirable to affix the tubing to the director fitting and spray nozzles by more robust threaded unions 77, as depicted in FIG. 11. Also, in spray applications where the spray nozzles are selectively movable during usage, it may be desirable for the tubing or hose to be connected to the director fitting and nozzles by threaded unions to prevent inadvertent dislodgement. In spray environments where it is unnecessary for the spray nozzles to be movably located relative to the spray guns, alternatively spray nozzles may be directly mounted in the director fitting 50 by a push/pull fitting, as depicted in FIG. 12, or by a threaded fitting, as depicted in FIG. 13.

In the illustrated embodiment, it will be seen that when the valve needle 30 is moved to the shutoff position, pressurized air will continue to be directed through the air guide 14, impact adaptor 40, and director fitting 50, and into and through the respective tubes 60 for clearing out remaining moisture within the length of the tubes 60. In some instances, such as in lubrication systems in which oil is being sprayed, it may be desirable to have a more responsive shutoff of the atomized liquid from the nozzles.

Figure 14A:
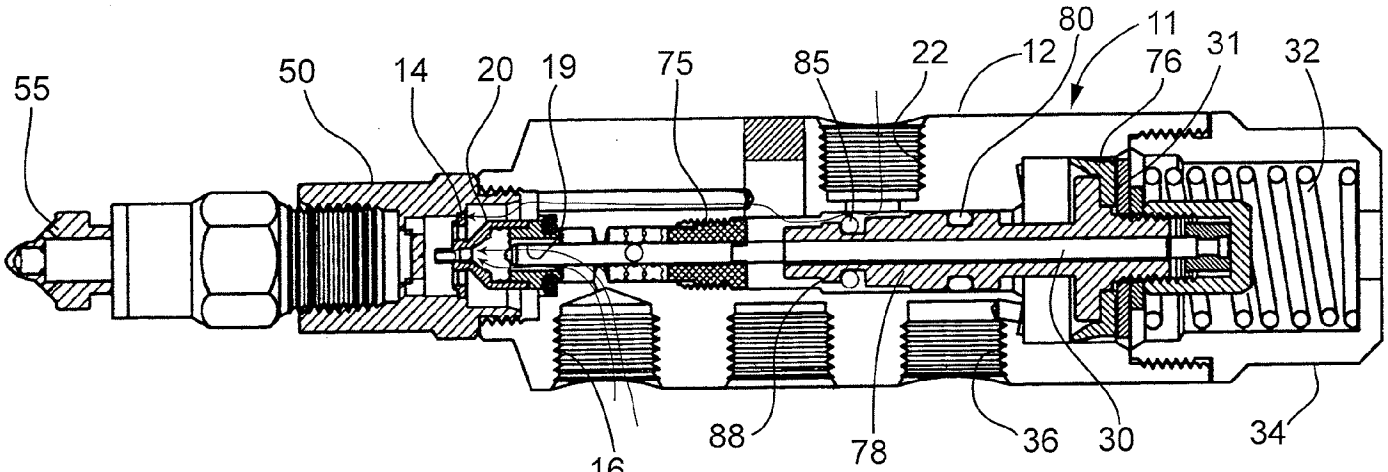
FIG. 14A is a longitudinal section of a further alternative embodiment of the present invention showing the valve control needle and piston in a retracted or open position.
Figure 14B:
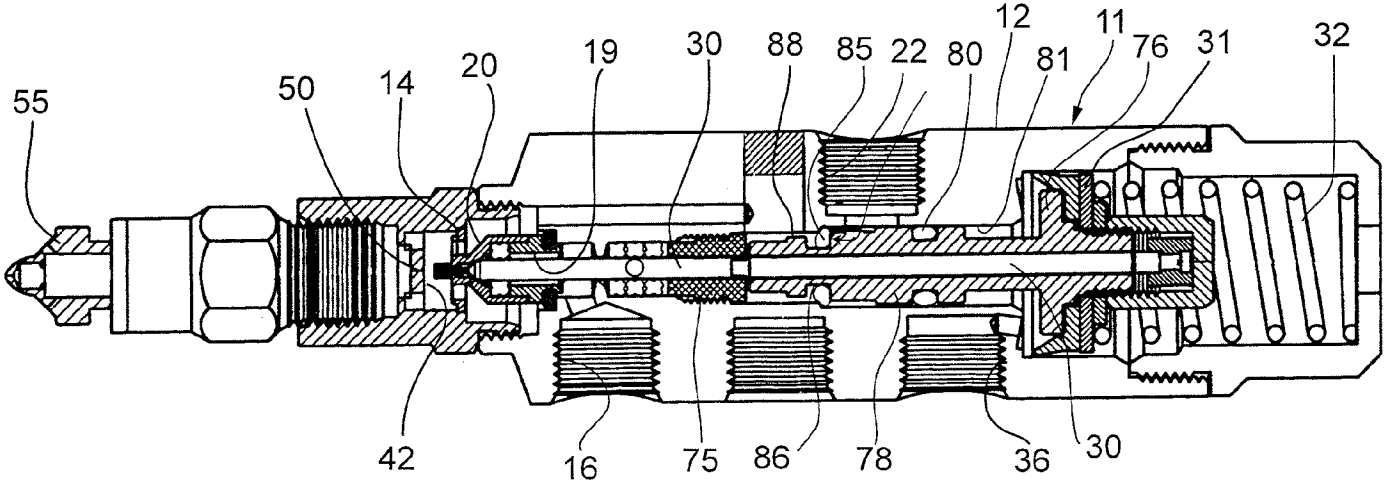
FIG. 14B is a longitudinal section of the spray device shown in FIG. 14A with the valve control needle and piston in a forwardly closed position.

In keeping with a further embodiment, the spray gun may be adapted for simultaneously interrupting the flow of pressurized air through the tubes 60 and spray nozzles 55 upon movement of the needle 30 to a shutoff position. With reference to FIGS. 14A and 14B, an illustrated alternative embodiment a spray gun 11 in depicted, wherein items similar to those described above have been given similar reference numerals. The spray gun 11 similarly has a body 12 with a liquid inlet 16 for communicating pressurized liquid to a central liquid flow passage 19 communicating with a liquid discharge spray tip 20, an air guide 14, impact adaptor 50, a reciprocatable valve needle 30 and piston assembly 31 for controlling liquid discharge from the spray gun, a central air inlet 36 for communicating pressurized air for moving the piston assembly 31 and valve needle 30 toward an open position against the force of a biasing spring 32, and an atomizing air inlet 22 for communicating pressurized air through the air guide 14 about the spray tip 20 for interaction and pressurized air atomization of liquid as it is emitted from the spray tip 20 and impinged upon an impingement surface 42, as described above. The valve needle 30 in this case is supported for reciprocating movement by a bushing 75 fixed centrally within the body 12. The piston assembly 31 includes an enlarged diameter piston head 76 fixed to an upstream end of the valve needle 30 and a reduced diameter forwardly extending stem 78 affixed for movement with the valve needle 30. The stem 78 in this case has an outwardly opening annular groove about its outer periphery for retaining an O-ring 80 for sliding sealing engagement within a cylindrical bore 81 of the body 12 within which the stem 78 is supported for sealing the piston air from the atomizing air.

In carrying out this embodiment, the valve stem 78 carries a second O-ring 85 within a second annular groove or recess 86 on the valve stem 78 for movement with the valve needle 30 and stem 78 between a 1) valve retracted or open position (depicted in FIG. 14A) in which atomizing air is directed through the atomizing air inlet 22, about the O-ring 85, and a reduced diameter, in this case stepped, downstream end portion 88 of the valve stem 78 for communicating atomizing air through the air guide 14 and about the downstream spray tip 20 for interaction with the discharging liquid and a 2) spray tip closing position, depicted in FIG. 14B, in which the valve needle 30 closes the spray tip 20 and simultaneously moves the O-ring 85 into sealingly engagement with a seating area of the valve body 11 downstream of the atomizing air inlet 22 for simultaneously interrupting the flow of atomizing air through the spray gun. For enabling optimally timed shutoff of the atomizing air with respect to shutoff of the liquid flow through the spray tip, the valve stem grove 86 within which the O-ring 85 is disposed has an axial length greater than the diameter of the O-ring 85 for permitting limited axial movement of the O-ring 85 during movement of the valve stem 78 between the retracted position in which the O-ring 85 is disposed adjacent a downstream side of the groove 86, as depicted in FIG. 14A and a spray tip shutoff position in which the O-ring 85 is disposed adjacent an upstream side of the groove 86.

From the foregoing, it can been seen that a pressurized air atomizing liquid spray nozzle assembly is provided that is adapted for highly versatile usage. The spray nozzle assembly is operable for generating finely atomized liquid that can be selectively directed to a plurality of different target areas or discharge locations remote from the central spray gun. The design of the spray assembly also can be easily adapted for the desired shutoff of the atomizing air. Yet, the pressurized air atomizing spray nozzle assembly of the present invention is relatively simple in construction and lends itself to economical manufacture and use.

The invention claimed is:

1. A pressurized air atomized liquid spray device comprising:

an atomizing unit having a liquid inlet for communicating pressurized liquid from a pressurized liquid supply to a central liquid passage having a discharge orifice through which the liquid is forcefully directed, an impingement element defining impingement element defining impingement surface disposed in aligned relation to said liquid discharge orifice against which a liquid steam discharging from the liquid discharge orifice will impinge and shatter into liquid particles that are dispersed radially outwardly of the impingement surface, said atomizing unit having an atomizing air inlet for communicating pressurized air from a pressurized air source into communication with at least one air passageway oriented for directing the pressurized air stream for interaction with liquid impinging from said impingement surface for causing interaction and further liquid breakdown into atomized liquid particles for direction into an expansion chamber entirely downstream of said impingement element, said expansion chamber having an uninterrupted cross section greater in diameter than the diameter of the impingement surface, said atomizing unit having a plurality of atomized liquid direction passages communicating with said downstream expansion chamber disposed in eccentric relation to said central liquid flow passage, a plurality of tubes each communicating with a respective one of said atomized liquid direction passages for receiving and transmitting atomized liquid, and a spray nozzle coupled to a downstream end of each tube for discharging an atomized liquid spray at the respective location of the spray nozzle.

2. The pressurized air atomizing liquid spray device of claim 1 in which said tubes each are an elongated flexible tube for selected positioning of the respective spray nozzle coupled thereto with respect to said atomizing unit.

3. The pressurized air atomizing liquid spray device of claim 1 in which said liquid discharge orifice of said central liquid passage is defined by a spray tip having an inwardly converging liquid passageway for accelerating liquid discharging from said liquid outlet into engagement with said impingement surface.

4. The pressurized air atomizing liquid spray device of claim 1 in which said atomizing unit includes a plurality of circumferentially spaced passageways about said impingement surface for communicating atomized liquid particles to said downstream expansion chamber.

5. The pressurized air atomizing liquid spray device of claim 4 in which said circumferentially spaced passageways about said impingement surface each have a partial end wall at a downstream end that defines a flat deflection surface for channeling the preatomized liquid in a downstream direction while further enhancing liquid particle breakdown.

6. The pressurized air atomizing liquid spray device of claim 1 in which said tubes each are secured to a respective one of said eccentric passages by a push type hose fitting for positively engaging and retaining the end of a hose positioned into the fitting.

7. The pressurized air atomizing liquid spray device of claim 6 in which said spray nozzles are each connected to a respective one of said tubes by a push type hose fitting into which a downstream end of the hose can be inserted and retained.

8. The pressurized air atomizing liquid spray device of claim 1 in which said each hose fitting is threadedly secured to a respective one of said eccentric passages.

9. The pressurized air atomizing liquid spray device of claim 1 in which said spray nozzles each include an elongated body portion having a central liquid passage, a plurality of discharge orifices adjacent a downstream end communicating with the central passage, and a closed nose portion which defines an internal mixing chamber downstream of said discharge orifices.

10. The pressurized air atomizing liquid spray device of claim 9 in which said internal mixing chamber has a diameter of about one half the diameter of the spray tip central passage.

11. The pressurized air atomizing liquid spray device of claim 10 in which said mixing cavity extends downstream of said discharge orifices a distance at least greater than the diameter of the spray tip central passage.

12. The pressurized air atomizing liquid spray device of claim 1 in which said atomizing unit includes a body having said liquid inlet and atomizing air inlet, an air guide coupled to a downstream end of said body which defines said at least one air passageway, an impact adaptor coupled to a downstream end of said air guide which defines said impingement surface, and a atomized liquid director fitting coupled to a downstream end of said impact adaptor which defines said plurality of eccentric passages.

13. The pressurized air atomizing liquid spray device of claim 12 in which said impact adaptor include said circumferentially spaced passageways about said impingement surface each having a partial end wall at a downstream end that defines a flat deflection surface for channeling the preatomized liquid in a downstream direction while further enhancing liquid particle breakdown, said spray nozzles each having an elongated body portion having a central liquid passage, a plurality of discharge orifices adjacent a downstream end communicating with the central passage, and a closed nose portion which defines an internal mixing chamber downstream of said discharge orifices.

* * * * *